United States Patent [19]

Mori et al.

[11] Patent Number: 4,724,659

[45] Date of Patent: Feb. 16, 1988

[54] BAND TYPE STRAPPING MACHINE

[75] Inventors: Motoaki Mori; Toyohiko Okuhara; Kikuo Nakano; Tadao Sasagawa; Jun Hayama, all of Yokohama, Japan

[73] Assignee: Nichiro Kogyo Company Ltd., Yokohama, Japan

[21] Appl. No.: 928,166

[22] Filed: Nov. 7, 1986

[30] Foreign Application Priority Data

Dec. 24, 1985 [JP] Japan ..... 60-198977[U]
Jan. 11, 1986 [JP] Japan ..... 61-2337[U]
Feb. 6, 1986 [JP] Japan ..... 61-16223[U]

[51] Int. Cl.[4] ..... B65B 13/22
[52] U.S. Cl. ..... 53/589; 100/29
[58] Field of Search ..... 100/29, 33 PB; 53/589

[56] References Cited

U.S. PATENT DOCUMENTS 171,560 12/1875 Gilman ..... 100/29
3,309,839 3/1967 Lyon ..... 53/589 X
3,665,845 5/1972 Lyon ..... 53/589 X
4,306,400 12/1981 Coleman et al. ..... 53/373
4,383,881 5/1983 Sakaki ..... 53/589 X
4,605,456 8/1986 Annis ..... 53/589 X

FOREIGN PATENT DOCUMENTS 0203278 3/1986 European Pat. Off. .

*Primary Examiner*—John Sipos
*Attorney, Agent, or Firm*—Oblon, Fisher, Spivak, McClelland & Maier

[57] ABSTRACT

A band type strapping machine comprises a band feeding roller and a band returning roller wherein a first pressing roller is placed above the band feeding roller so as to be able to come in contact with the feeding roller, a second pressing roller is placed below the band returning roller so as to be able to come in contact with the returning roller and the band feeding roller and the band returing roller are driven in the same direction by a motor.

4 Claims, 7 Drawing Figures

BAND TYPE STRAPPING MACHINE

BACKGROUND OF THE INVENTION

The present invention relates to a band type strapping machine. More particularly, it relates to a band feeding and pull-tightening means in the band type strapping machine, in which operations for feeding and pulling a plastic band can be performed with a simple structure.

There have been known band type strapping machines which have a band guide on a table on which a package to be packed is placed and are adapted to feed a plastic band around the package, the band then being pulled back to be tightened on the package. The conventional band type strapping machine are generally classified into two groups. The strapping machines belonging to the first group are ones such that, for instance, as shown in Japanese Examined Utility Model publication No. 56082/1980, a feeding roller and a tightening roller are placed at a juxtaposition and a driving roller is disposed above each of the rollers so that the driving rollers are selectively brought into contact with the feeding and tightening rollers, whereby a band-feeding or band-tightening operation is performed. In this case, a gearing device is interposed between the feeding roller and the tightening roller so that the former is driven to feed the band, while the later is driven to return and tighten the band on the package.

The strapping machines belonging to the second group are so constructed that a single driving roller is driven by a reversible electric motor and the roller is brought into contact with a driven roller to feeding or returning a band.

The strapping machines of the first group have disadvantages that they push up cost for manufacturing because the gearing device is interposed between the feeding and tightening rollers and that they generate large noise during operations.

The strapping machines belonging to the second group have a problem of cost because the expensive reversible motor has to be used.

Further, in the conventional band type strapping machines, there has been known means for adjusting tension of the band when the driving roller is forcibly brought into contact with the return roller to pull back and tighten the band. Such means is published in, for instance, Japanese Examined Utility Model publication No. 23280/1965. The tension adjusting means is provided with an inclinable lever, a pawl and a receiving piece in which the pawl and the receiving piece are fitted to the inclinable lever. When the inclinable lever is inclined, a band is gripped by the pawl and the receiving piece so that the band is forcibly pulled in the direction of returning the band by the action of a spring provided in the inclinable lever. When the inclinable lever is inclined in the opposite direction, the pawl is disengaged from the receiving piece to release the band.

Thus, in the tension adjuster which performs feeding of the band by causing inclination of the lever in one direction to release the band, and strongly returning the band by causing inclination of the lever in the opposite direction, movement of inclination of the lever is actuated by detecting tension of the band with use of a band tension sensing means by which a solenoid is energized or deenergized.

The conventional machine, however, has a complicated structure such that provision of the solenoid device for actuating the inclinable lever, the band tension sensing means for actuating the solenoid device, a spring for strongly returning the band, and so fourth is needed. Further, accuracy of timing of actuating solenoid device is not satisfactory.

SUMMARY OF THE INVENTION

An object of the present invention is to provide a band type strapping machine which is simple in structure, of a reduced cost and free from great noise during the operations.

The foregoing and the other object of the present invention have been attained by providing a band type strapping machine comprising a band feeding roller and a band returning roller, characterized in that a first driving roller is placed above the band feeding roller so as to be able to come in contact with the feeding roller, a second driving roller is placed below the band returning roller so as to be able to come in contact with the returning roller, a belt engaged with the band feeding roller and the band returning roller so that the both rollers are driven in the same direction and a motor for driving the belt.

DETAILED DESCRIPTION OF THE PREFERRED EMBODIMENTS

An embodiment of the present invention will be described with reference to the drawings.

Figure 1:
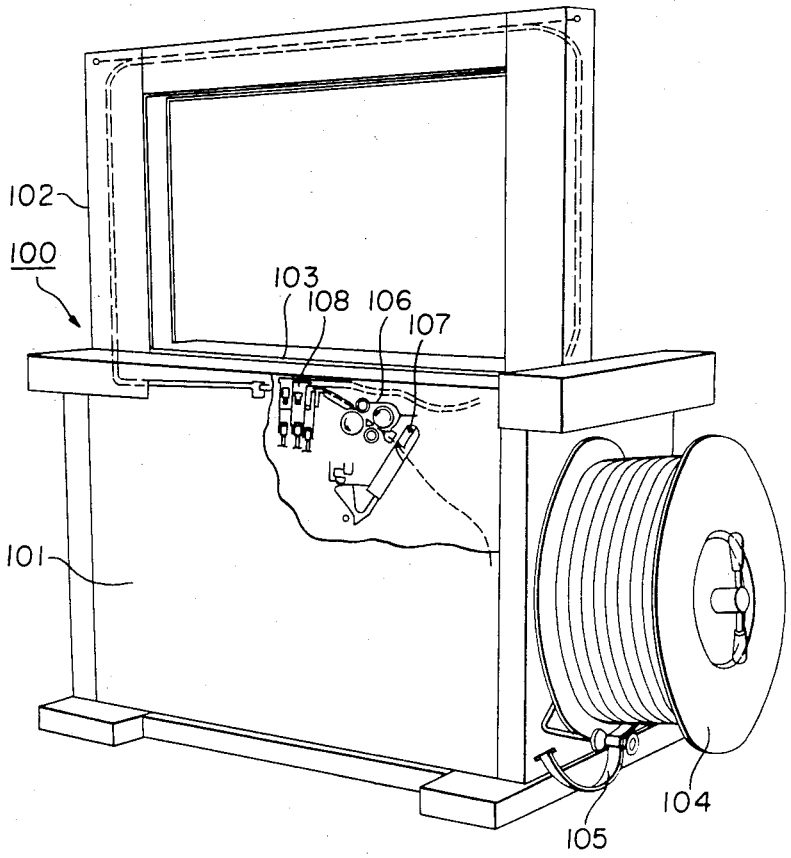
FIG. 1 is a perspective view partly broken of a band type strapping machine to which the present invention is applied.

In FIG. 1, a reference numeral 100 designates as a whole a band type strapping machine in which the present invention is utilized. The strapping machine comprises a main body 101, a band guiding arch 102, a table 103 for receiving a package around which a plastic band is wound, a band reel 104 for holding the plastic band 105, a band feeding and returning roller means 106, a band tension adjusting means 107 operable in association with the band feeding and returning roller means 106, and a band gripping, heat-bonding and cutting means 108.

The internal structure of the band type strapping machine will be described in more detail.

Figure 2:
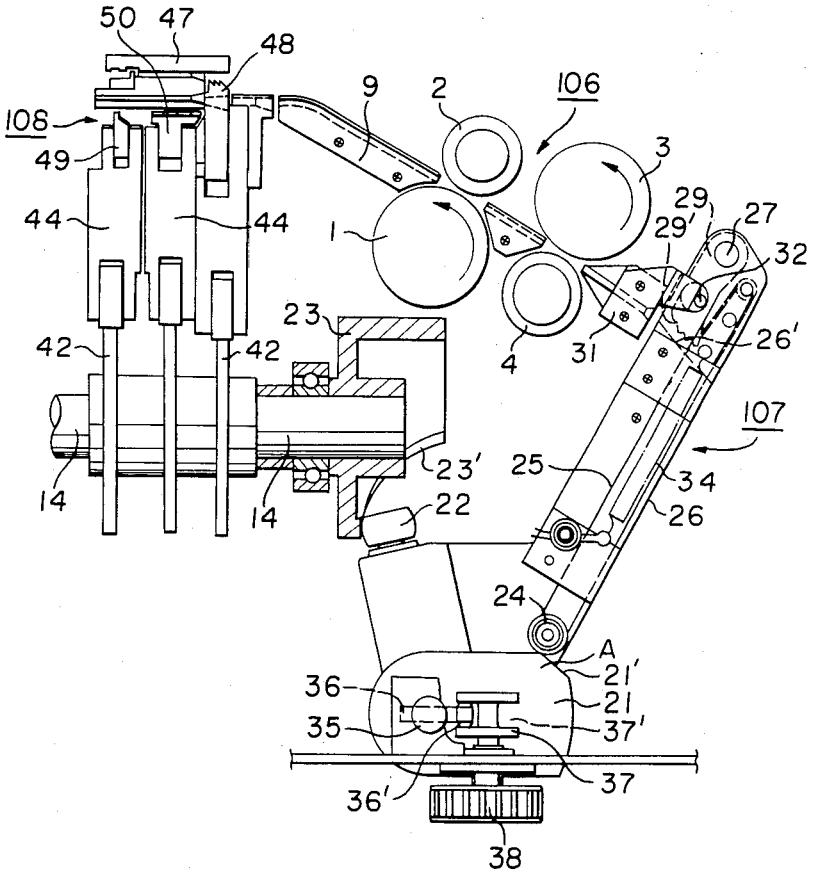
FIG. 2 is a front view showing the main structural part of an embodiment of the band type strapping machine according to the present invention.
Figure 3:
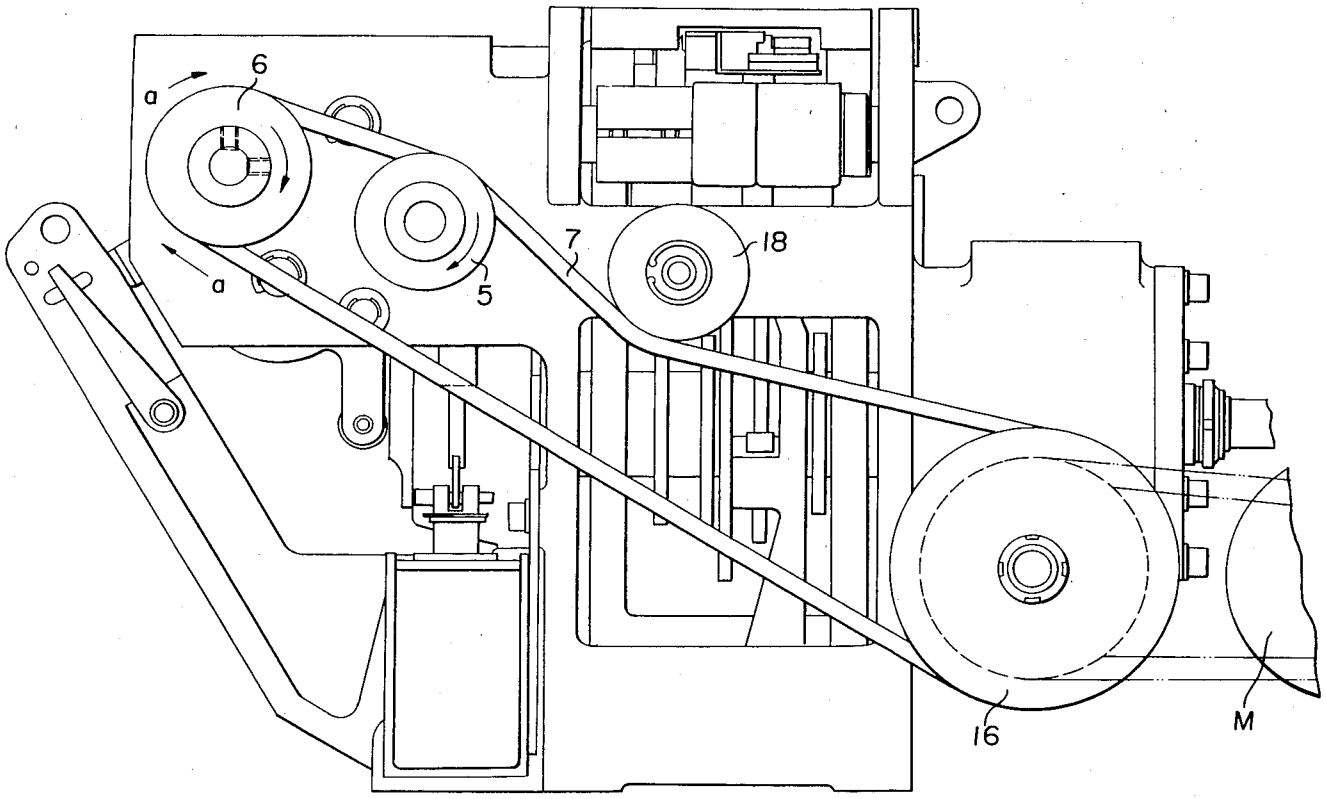
FIG. 3 is a front view of a driving section in the band type strapping machine in which a belt is wound around a pulley for each of feeding and pulling rollers.
Figure 4:
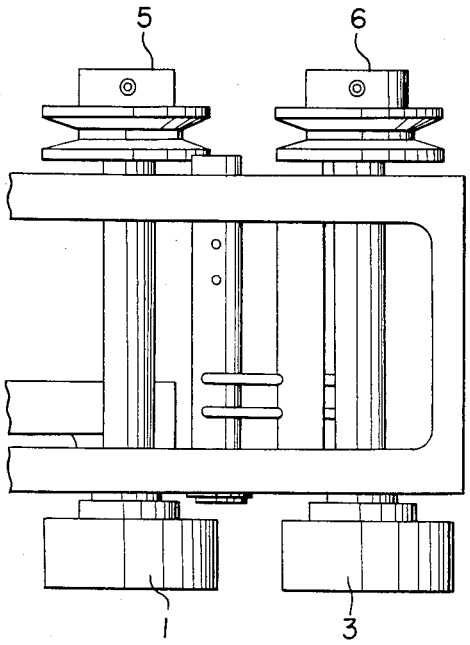
FIG. 4 is a plan view showing the band feeding roller and the band returning roller and the pulleys respectively connected to the rollers.

In FIGS. 2 to 4, the band feeding and returning roller means 106 comprises a band feeding roller 1 which is usually rotated in the band-feeding direction, a first pressing roller 2 placed above the feeding roller 1 to be in press-contact with the feeding roller through the plastic band, a band returning roller 3 and a second pressing roller 4 disposed below the band returning roller 3 to be in press-contact with the returning roller 3.

A first pulley 5 is integrally connected to the band feeding roller 1 through a first shaft, and a second pulley 6 is integrally connected to the band returning roller 3 through a second shaft. A belt 7 is wound around the pulleys 5, 6 and a driving wheel 16 having a relatively large diameter. The pulleys 5, 6 are driven in the same direction, i.e. in the direction indicated by the character a by a motor M through the driving wheel 16. A numeral 18 designates an idle roller. In the arrangement of the band feeding and returning rollers, both being rotated in the same direction as shown in FIG. 2, the band feeding roller 1 operates to feed the band in the band-forwarding direction, while the band returning roller 3 operates to feed the band in the band returning direction because the first pressing roller 2 is provided above the band feeding roller 1 and the second pressing roller 4 is placed below the band returning roller 3. A numeral 9 designates a band guiding channel.

A reference numeral 48 designates a right gripper which operates to secure the free end of the plastic band wound around the package on the table in association with a sealing anvil 47 and which is provided the top end of the push rod 44 vertically movable by the action of a cam 42 depending on the revolution of a cam shaft 14. A numeral 50 designates a compression head which melt-bonds the inner surface of the free end of the plastic band wound around the package and the inner surface of the same band at the returning side, by pressing them from the lower part and which is provided at the top end of a push rod 44 vertically movable by means of the cam 42. A numeral 44 designates a left gripper 49 which secures the plastic band in association with the sealing anvil 47 after the band has been tightened by the action of the band returning roller 3, the free end of the band being previously secured between the sealing anvil 47 and the right gripper 48. The left gripper 49 is also provided at the top end of a push rod 44 which is vertically movable by the cam 42. Reference numerals 43 designate cam rollers provided at the top of the cams 42.

Figure 5:
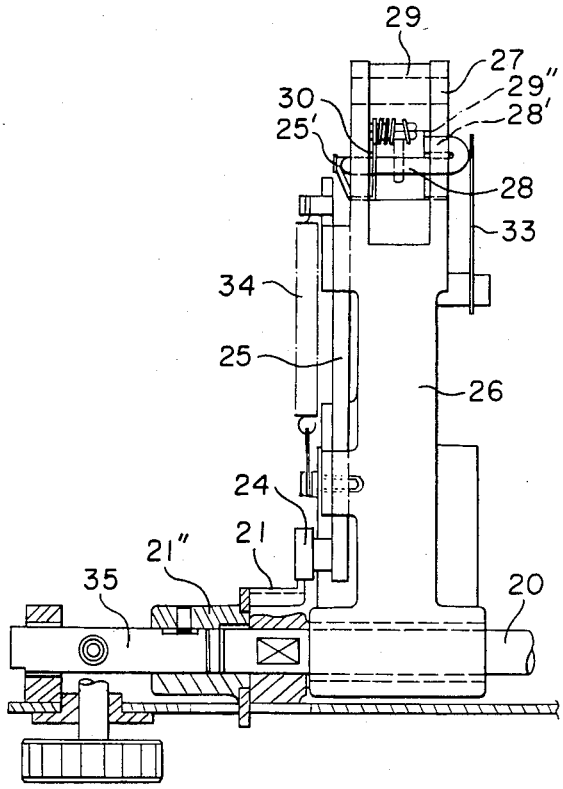
FIG. 5 is a side view of an inclinable lever as an important part of the present invention.
Figure 7:
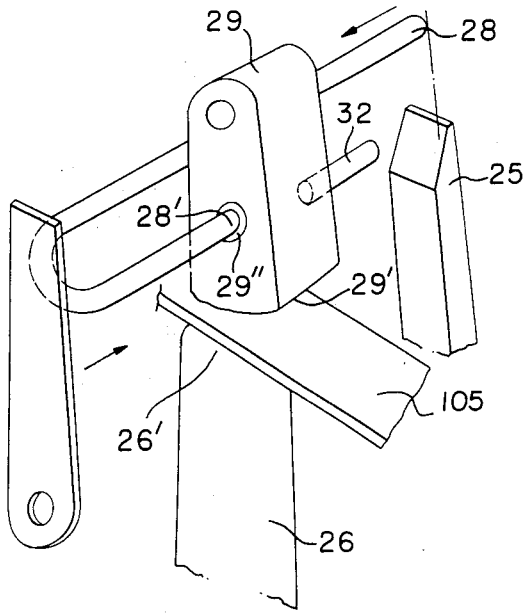
FIG. 7 an enlarged diagram showing a part for returning the band according to the present invention.

The structure of the band tension adjusting means 107 will be described with reference to FIGS. 2, 5 and 7.

A tension lever 26 is attached to the machine frame of the main body 101 by a pivotal shaft 20 so that the tension lever is oscillable around the pivotal shaft 20. A cam follower 22 attached to the base portion of the tension lever 26 is always in contact with the cam surface 23' of a cam 23 which is attached to an end of the cam shaft 14 so as to move the tension lever 26 around the shaft 20 in accordance with the shape of the cam surface 23'.

A slide bar 25 is provided along the longitudinal axis of the tension lever 26 so as to be slidable therealong. A spring 34 is extended between the upper part of the slide bar 25 and a lower part of the tension lever 26, whereby the slide bar 25 is usually pulled downwardly. A cam roller 24 is attached at the lower end of the slide bar 25 so that the cam roller 24 rolls on the cam surface 21' of an adjusting cam 21. A boss 21" of the adjusting cam 21 is firmly connected to an adjusting shaft 35 which is connected to the pivotal shaft 20 in the same axial line. The adjusting shaft 35 is provided with an adjusting pin 36 extending in the horizontal direction, and the head 36' of the adjusting pin 36 is inserted in a recess 37' formed in the base portion 37 of an adjusting knob 38.

The top end 25' of the slide bar 25 is engageable with an end of a U-shaped stopper 28. The other end 28' of the U-shaped stopper 28 is fitted in a recess 29" formed in a gripper 29 which is pivotally supported by a pin 27 extended in a forked portion formed at the upper part of the tension lever 26.

A helical spring 30 is mounted on the gripper 29 with its one end engaged with the tension lever 26 so that the gripper 29 is always urged in the clockwise direction with the result that the plastic band is gripped between a slanting surface 29' formed in the lower part of the gripper 29 and a slanting surface 26' formed in the base of the forked portion of the tension lever 26. A plate spring 33 pushes the U-shaped portion of the stopper 28 so that the one end 28' of the stopper 28 is always fitted in the recess 29" of the gripper 29. A pin 32 is secured to the gripper 29, and the pin 32 is engageable with a stop lever 31 as a fixed member. When the tension lever 26 is turned around the pivotal shaft 20 and the pin 32 of the gripper 29 comes to contact with the stop lever 31, the slanting surface 29' of the gripper 29 is disengaged with the slanting surface 26' of the tension lever 26, whereby the plastic band 105 is released.

When the cam shaft 14 is rotated, hence the cam 23 is rotated, the tension lever 26 is moved in the clockwise direction around the pivotal shaft 20 since the cam follower 22 follows the cam surface 23' of the cam 23. Then, the pin 32 of the gripper 29 is disengaged with the stop lever 31. The cam roller 24 at the lower end of the tension lever 26 moves along the cam surface 21' of the adjusting cam 21. When the cam roller 24 reaches a point A on the cam surface 21', the slide bar 25 is pushed upwardly by the movement of the cam roller 24, whereby the upper end 25' of the slide bar 25 pushes the one end of the U-shaped stopper 28. Then, the other end 28' of the stopper 28 comes off the recess 29" of the gripper 29, so that the gripper 29 becomes free. Accordingly, the gripper 29 turns by the action of the helical spring 30 so that the plastic band is gripped between the slanting surface 29' of the gripper 29 and the slanting surface 26' of the tension lever 26. Since the tension lever is turned in the clockwise direction, the plastic band gripped is strongly pulled; thus, a strong tightening force is given to the band.

On completion of the band tightening operations, the tension lever 26 is moved in the counterclockwise direction by the action of the cam 23, and the pin 32 of the gripper 29 comes in contact with the stopper lever 31, whereby the gripper 29 is returned to the original position, and the other end 28' of the stopper 28 is again fitted to the recess 29" of the gripper 29. The tightening force by the tension lever 26 can be adjusted by turning the adjusting knob 38, whereby the angular position of the adjusting shaft, i.e. the angle of the adjusting cam 21 with respect to the cam roller 24 is changed by means of the adjusting pin 36. The tightening force to the plastic band is in proportion to the length from the point where the band is gripped by the gripper 29 to the point where the tightening of the band is effected.

Figure 6:
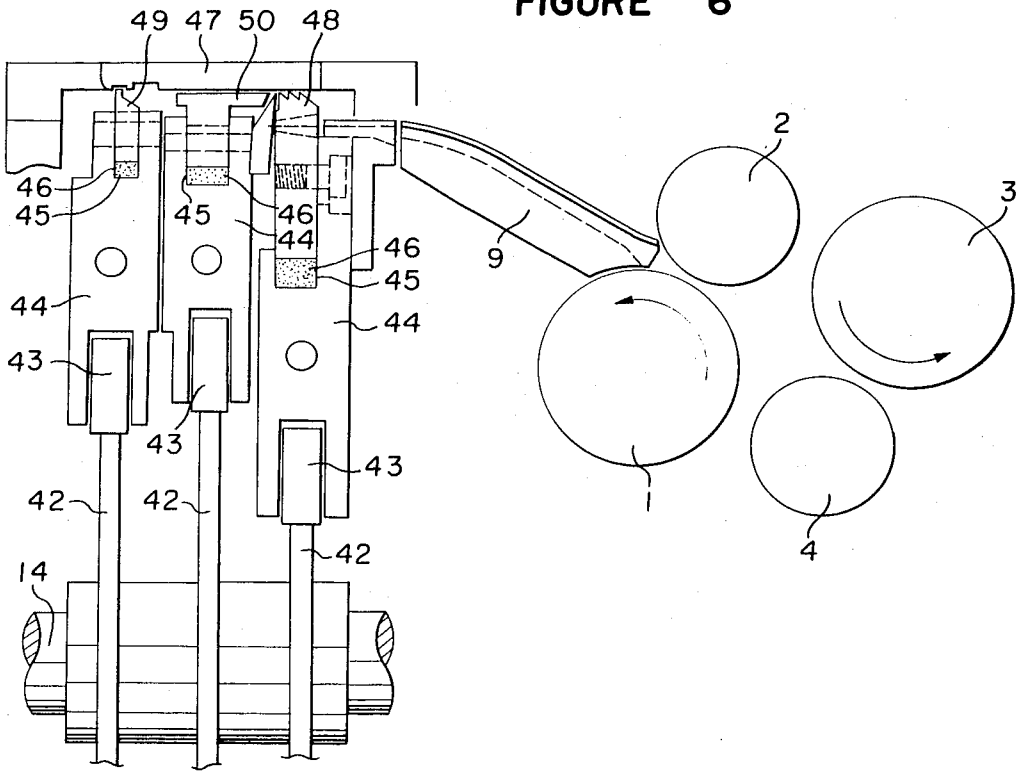
FIG. 6 is a diagram showing a mechanism of gripping, heat-bonding and cutting of the plastic band in association with cam means.

FIG. 6 is a diagram showing the band gripping, heat-bonding, cutting means 108 which grips the band at two positions after the band is wound around the package and the band is pulled at its returning side; heat-bonds an overlapped portion of the band; and cutting the band. The sealing anvil 47 is provided below the table for receiving the package. The right gripper 48, the left gripper 49 and the compression head 50 are respectively fitted in insertion holes 45 formed in the first, second and third levers 44, at the bottom of each of the insertion holes 45 a polyurethane spring 46 is placed. At the lower part of each of the levers 44, a recess is formed, and the cam roller 43 is inserted in each of the recesses. The first, second and third cams 42 which are fixed to the cam shaft 14 are respectively in contact with the cam rollers 43. The right gripper, the compression head and left gripper are pressed to the sealing anvil by the respective levers 44 through the polyurethane springs 45. Accordingly, quick operation is obtainable in response to the action of the cams in comparison with the conventional mechanism using coil springs. Further, the right and left grippers and the compression head can be operated with a constant pressure and with correct parallelism.

As described above, in the present invention, the construction of the band feeding and returning means is extremely simple to thereby reducing cost of manufacture and a smooth operation is attained without noise because the structure is driven by a single belt.

Further, the cam attached to an end of the cam shaft provides timing for tightening of the band with a strong force. The rotation of the cam directly actuates the tension lever thereby performing tightening of the band. Accordingly, the strapping machine of the present invention can be formed compact and can be operated accurately.

In addition, the tightening force of the band is easily adjusted by adjusting the angle of the adjusting shaft, i.e. the angle of the adjusting cam because the cam roller of the slide bar provided on the tension lever is brought to contact with the adjusting cam provided on the adjusting shaft and the operation of the gripper is controlled by the slide bar.

We claim:

1. A band type strapping machine comprising a band feeder roller and a band returning roller characterized in that a first pressing roller is placed above said band feeding roller so as to be able to come in contact with said feeding roller, a second pressing roller is placed below said band returning roller so as to be able to come in contact with said returning roller, wherein said band feeding roller and said band returning roller are driven in the same direction by a motor, including a band-tension adjusting means which is swingable toward and away from said band returning roller in association with operations of right and left grippers and a compression head so that said band is gripped and strongly pulled when said band-tension adjusting means is away from said band returning roller, and said band is released from said adjusting means when it is swung toward said band returning roller, wherein said band-tension adjusting means comprises a cam attached to a cam shaft for driving said right and left grippers and said compression head, a tension lever swingable around a pivotal shaft, said tension lever having a cam follower which is in contact with said cam, a slide rod fitted to said tension lever so as to be slidable in its longitudinal direction, an adjusting cam attached to an adjusting shaft whose angular position is adjustable, a cam roller attached to the lower part of said slide rod and being in contact with said adjusting cam, a band gripper fitted to the upper part of said slide rod and urged in the clockwise direction by means of a coil spring, a stopper for restricting movement of said band gripper, and a slant surface formed in the lower surface of said band gripper so as to grip said band in association with a slant surface formed in said tension lever.

2. The band type strapping machine according to claim 1, wherein a pulley is connected to each of said band feeding roller and said band returning roller through each shaft; a driving wheel is driven by said motor; and a belt is wound around said pulleys and said driving wheel.

3. The band type strapping machine according to claim 2, wherein an idle roller is placed outside the loop of said belt to impart tension to said belt.

4. The band type strapping machine according to claim 1, which comprises a band heat-bonding means comprising said right gripper, said left gripper and said compression head, all being placed below a sealing anvil and moved through respective resilient member made of a resinous material by each lever which is connected by each cam means driven by a cam shaft.

* * * * *